US007628675B2

(12) United States Patent
Staub

(10) Patent No.: US 7,628,675 B2
(45) Date of Patent: Dec. 8, 2009

(54) GARMENT WITH INTERNAL BRA

(75) Inventor: AnDrea Staub, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 719 days.

(21) Appl. No.: 11/098,514

(22) Filed: Apr. 5, 2005

(65) Prior Publication Data

US 2006/0223414 A1 Oct. 5, 2006

(51) Int. Cl.
*A41C 3/00* (2006.01)

(52) U.S. Cl. ..... 450/28; 450/32; 450/31; 2/102

(58) Field of Classification Search ..... 450/7–32, 450/86, 88; 2/113, 115, 102, 75, 73, 78.1–78.4
See application file for complete search history.

(56) References Cited

U.S. PATENT DOCUMENTS 1,259,046 A * 3/1918 Reber ..... 2/113
2,264,972 A * 12/1941 Greenberg ..... 2/271
2,341,032 A * 2/1944 Freed et al. ..... 450/32
2,595,139 A * 4/1952 Hart ..... 450/28
2,869,552 A * 1/1959 Smith ..... 450/32
3,212,503 A * 10/1965 Gorman ..... 450/32

OTHER PUBLICATIONS http://niketown.nike.com/niketown/catalog/pdp.jsp-?productId=49319&productGroup=8665, Niketown.com : Adventure Top, Sleeveless, 1 sheet, Mar. 7, 2005.
http://niketown.nike.com/niketown/catalog/pdp.jsp-?productId=42118&productGroup=7073, Niketown.com : Seamless Fishnet Tank 1 sheet, Mar. 7, 2005.

* cited by examiner

*Primary Examiner*—Gloria Hale
(74) *Attorney, Agent, or Firm*—Banner & Witcoff, Ltd.

(57) ABSTRACT

An article of women's apparel that includes an outer garment and a bra. The bra is primarily internal to the outer garment. However, there is a reveal region that shows a portion of the bra. In one arrangement, the reveal region is formed by a pair of slits in a front shoulder region of the outer garment and portion of the bra which is revealed is a shoulder strap portion. This region is formed by routing the shoulder strap of the bra through the successive slits. In one arrangement, the outer garment is sleeveless and the reveal region is asymmetrical. A benefit of this arrangement is that a purchaser can determine the presence and type of support without having to approach and perform a detailed inspection of the garment.

10 Claims, 6 Drawing Sheets

GARMENT WITH INTERNAL BRA

BACKGROUND OF THE INVENTION

This invention relates to a garment for women having an internal bra. More specifically, the invention relates to a garment for women having an internal bra with a configuration providing a visual indicator of the internal bra.

DESCRIPTION OF BACKGROUND ART

Most upper garments for women do not provide adequate support for their breasts. This is especially true for upper garments intended to be used in sporting-related activity. Thus, most upper garments for women are worn in addition to a bra. Bras are garments worn by women to cover and support their breasts. Bras commonly include a front portion to cover the breasts, a portion that extends around the back, and shoulder straps connecting the front and rear portions so that the front portion can better support the breasts. Some upper garments have included additional support for the breast region. However, the existence and type of such additional support is not always evident to consumer. The present invention was developed to arrive at an improved upper garment for women having a visual indicator of the presence of an internal bra.

BRIEF SUMMARY OF THE INVENTION

The following presents a simplified summary of the invention in order to provide a better understanding of some aspects of the invention. It is not intended to be an extensive overview of the invention or aspects thereof. Nor is it intended to identify or define critical elements of the invention. This summary merely describes some aspects of the invention in a simplified manner as a prelude to the detailed description hereinafter.

It is an aspect of the invention to provide an article of apparel including a garment and a primarily internal bra. The garment covers a significant portion of the torso of a user, and includes a first slit and a second slit which are spaced from each other. The bra is coupled to the garment. The bra has a strap that extends through the first and second slits in succession. The primarily internal bra is exposed in a region between the first and second slits.

Another aspect of the present invention includes providing a garment having a torso covering body portion and first and second slits. The first and second slits are spaced from each other and are further sized and configured to enable a strap to pass through each in succession. Edge treatment of the material surrounding the first slit and the second slit is provided.

Yet another aspect is directed to a method of making an article of apparel. A garment is provided that includes at least two strap openings. A bra is provided that has a shoulder strap with a free end. The free end of the shoulder strap is routed through at least two strap openings in the garment to integrate the bra with the garment.

The various advantages and features of novelty that characterize the present invention are pointed out with particularity in the claims. To gain an improved understanding of the advantages and features of novelty that characterize the present invention, however, reference should be made to the enclosed detailed description and accompanying drawings which describe and illustrate various embodiments of the invention.

BRIEF DESCRIPTION OF THE DRAWINGS

FIG. 3 is a front view of the ladies garment of FIG. 1 with the garment turned in an inside-out configuration.

FIG. 6 is a front view of the ladies garment of FIG. 5 with the garment turned in an inside-out configuration.

DETAILED DESCRIPTION OF THE INVENTION

In the following description of the various embodiments, reference is made to the accompanying drawings that depict illustrative arrangements in which the invention may be practiced. It is understood that other embodiments may be utilized and modifications may be made without departing from the scope of the present invention. Additionally, various terms used herein are defined below.

Figure 3:
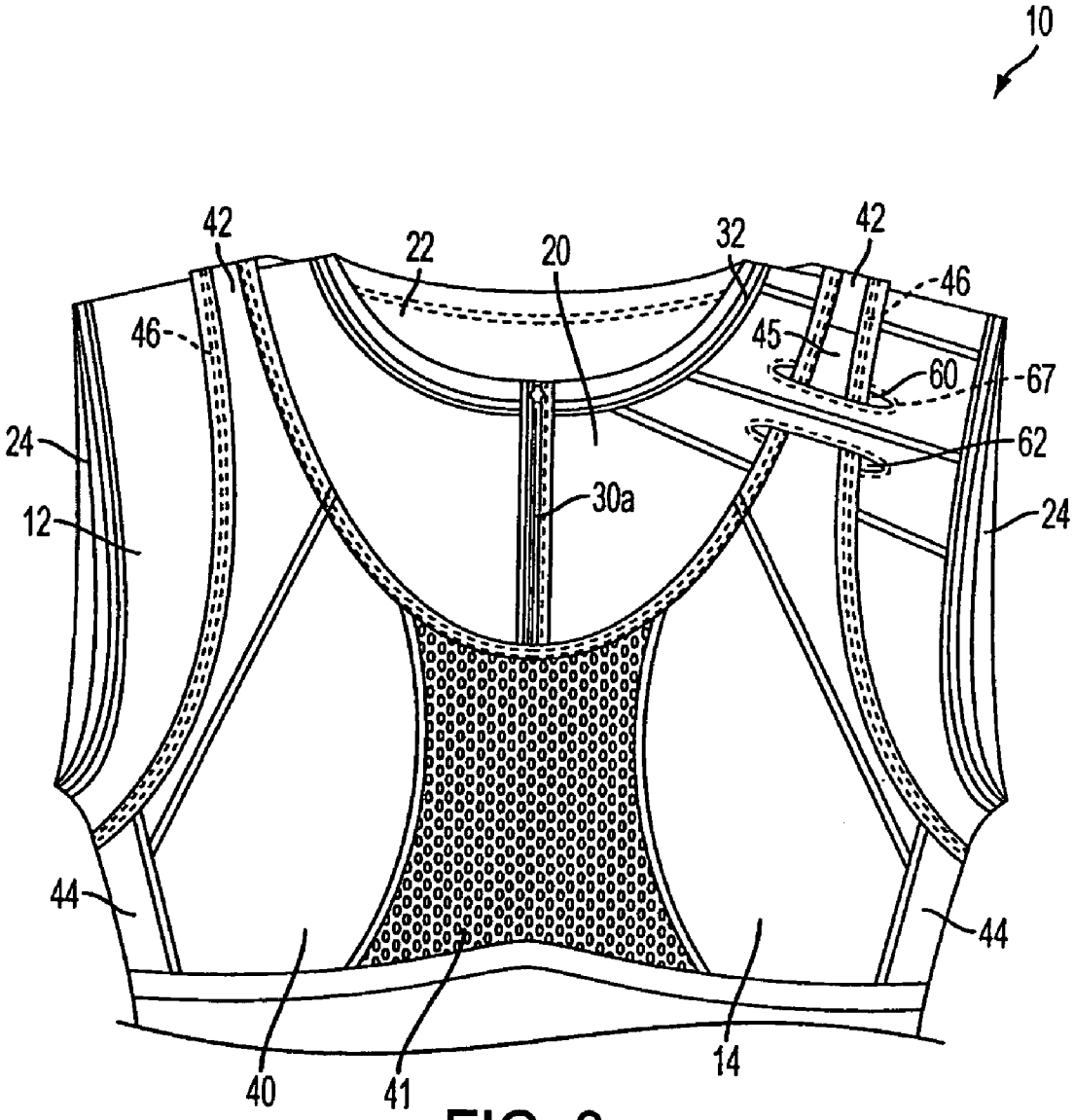
FIG. 3 is an internal view of the ladies garment of FIG. 1. That is.
Figure 4:
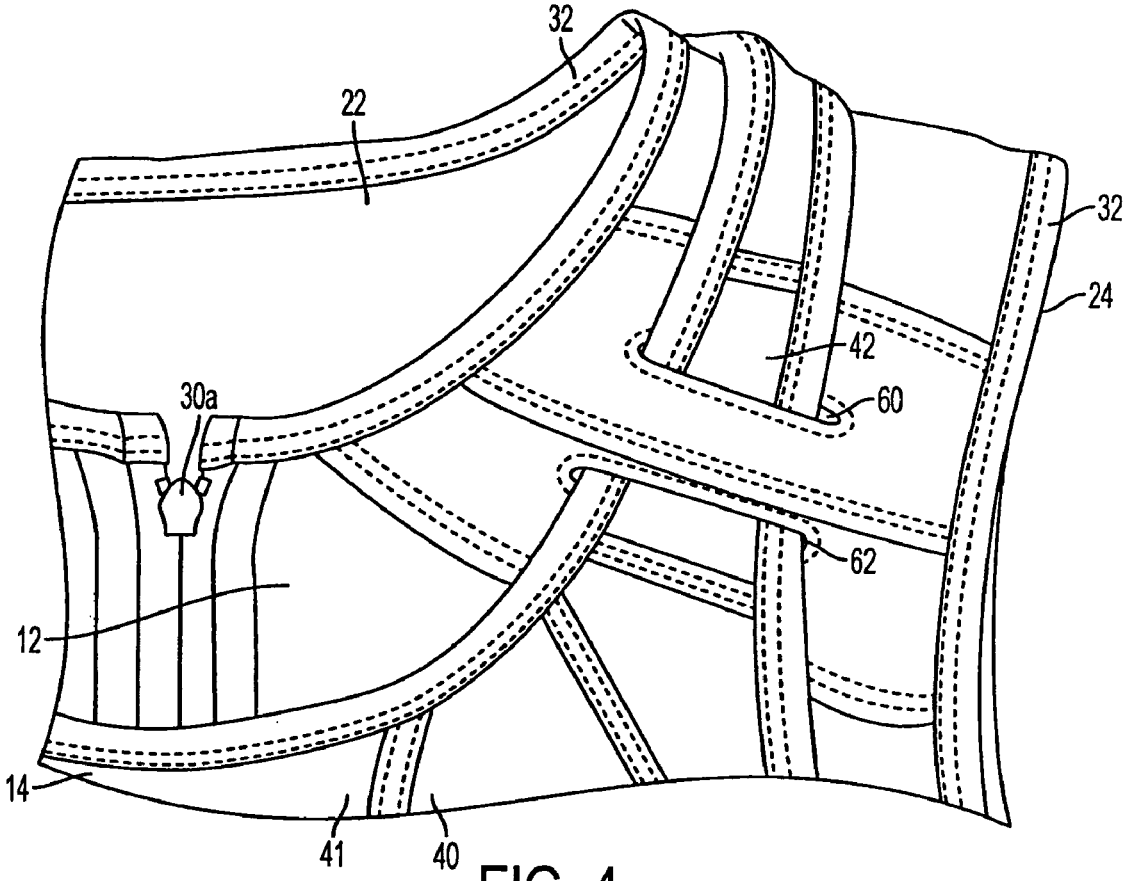
FIG. 4 is an enlarged detail view of the shoulder region of FIG. 3 with a few variations thereto.
Figure 5:
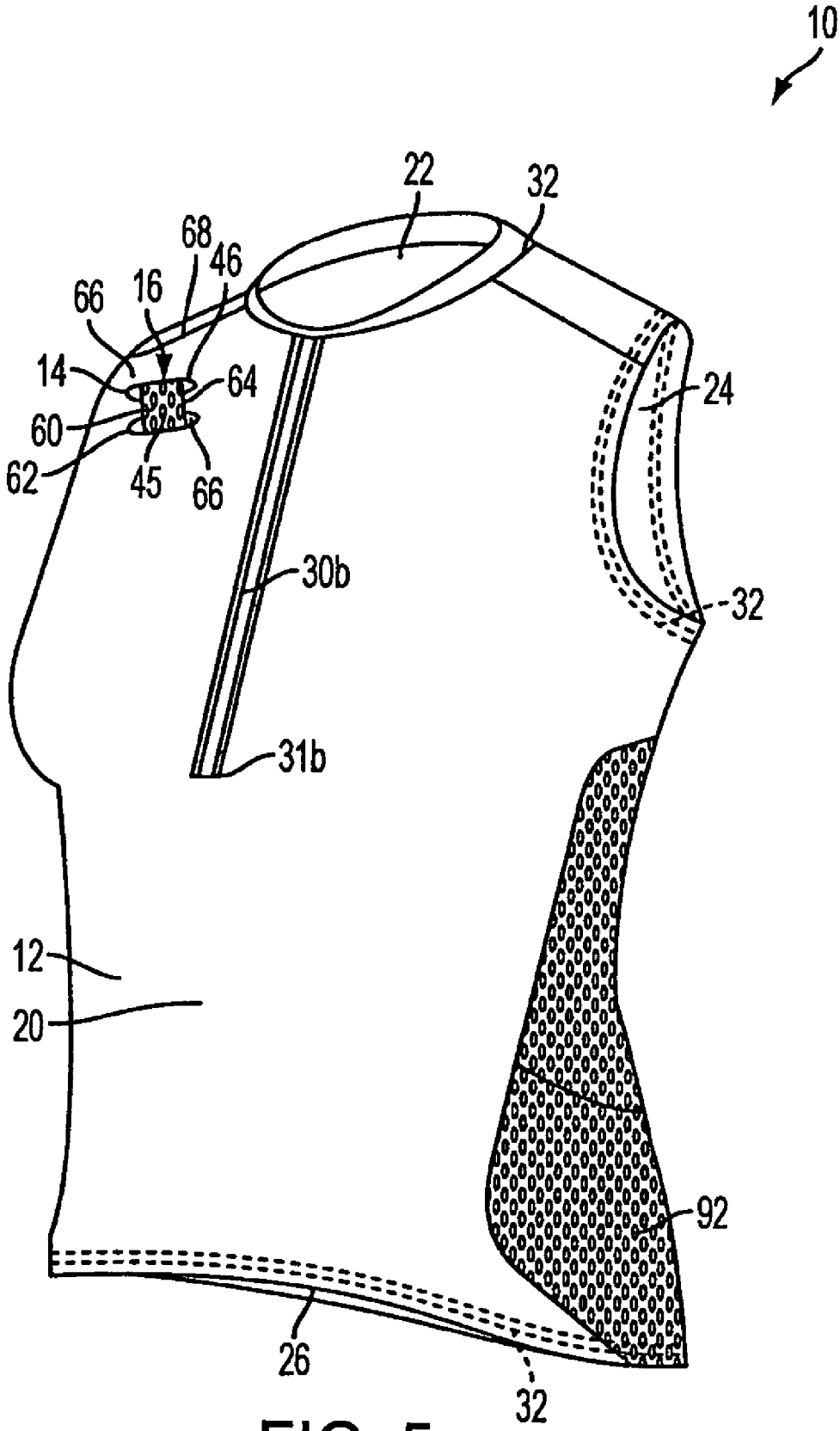
FIG. 5 is a front view of a variation of the ladies garment of FIG. 1.
Figure 6:
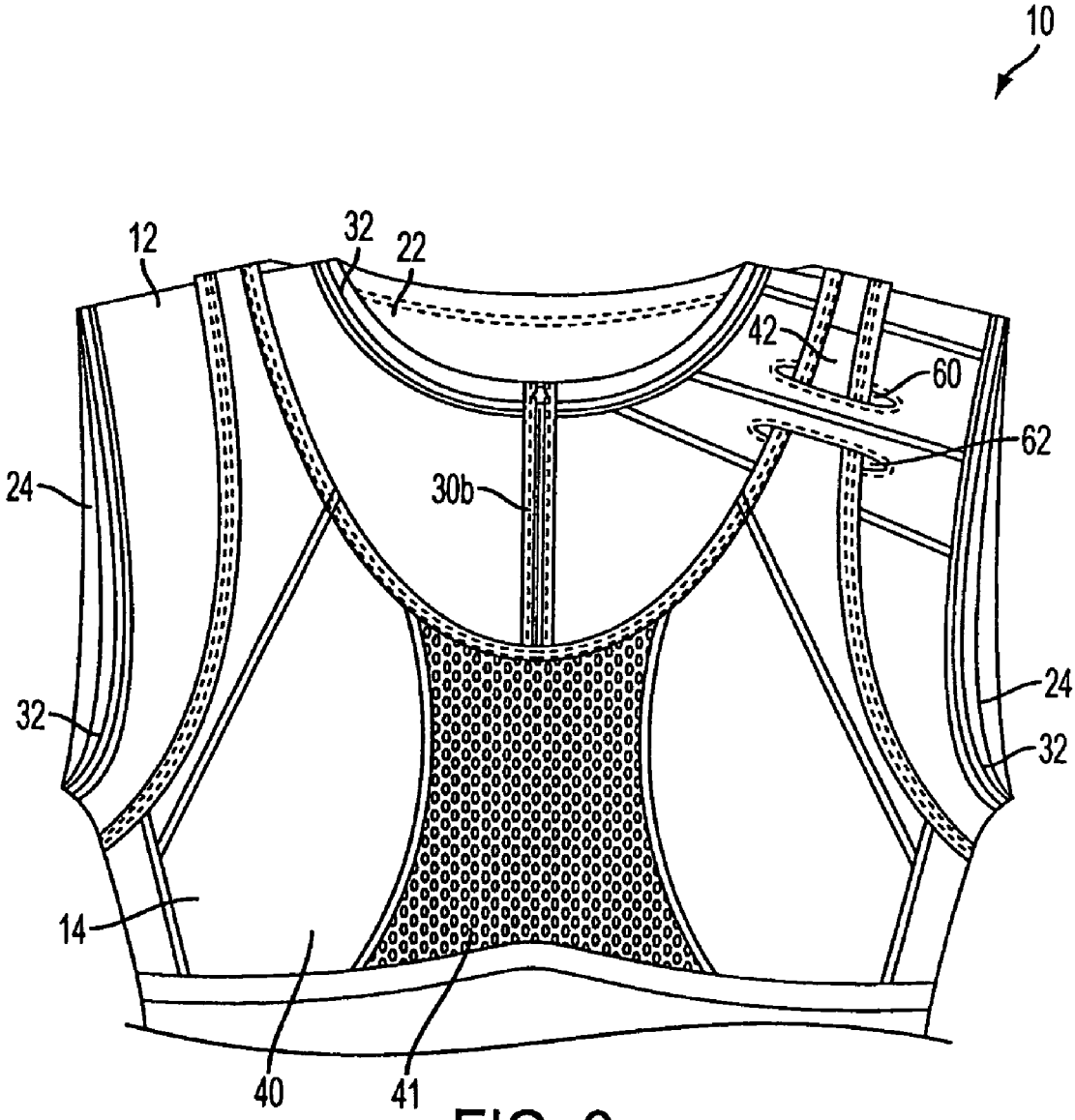
FIG. 6 is an internal view of the ladies garment of FIG. 5. That is

FIGS. 1-6 show illustrative embodiments of an improved garment designated with reference number 10. FIGS. 1-4 depict a first illustrative embodiment of the garment 10, while FIGS. 5-6 depict a variation to the garment. The garment 10 is intended for wear by a woman and includes an outer garment 12 and a bra 14. The outer garment 12 is preferably, but need not be, designed for athletic use where the functionality of an internal bra 14 has enhanced benefits. The outer garment 12 may have any of a number of different designs and/or types, and may be within the "running tops" or "sport tops" category. The bra 14 is substantially internal to the outer garment 12 and is referred to herein as an "internal bra." The internal bra 14 is intended to cover and provide support the breasts of the wearer. The outer garment 12 includes a reveal region 16 that exposes a portion of the internal bra 14. Among the benefits of this arrangement is that it provides a consumer with an immediate indicator that the garment 10 includes the functionality of a bra support system.

For general reference, clarity and ease of understanding, outer garment 12 may generally be described as having external and internal surfaces. The external surface of outer garment 12, as is commonly understood with respect to garments generally, is the surface visible to the public when a user is wearing a garment. In contrast, the internal surface is generally the surface opposing the external surface that is generally not visible to the public that sits on or near the skin of the body of a user/wearer. Most of the surface of the outer garment 12 visible in FIGS. 1, 2, and 5 may be considered external surfaces. However, certain surfaces visible in these figures (i.e. through the head opening 22 or arm opening 24) are considered internal surfaces. Likewise, most of the surfaces of the outer garment 12 visible in FIGS. 3, 4, and 6 are considered internal surfaces as the outer garment 12 is shown in an inside-out configuration in these figures.

Figure 1:
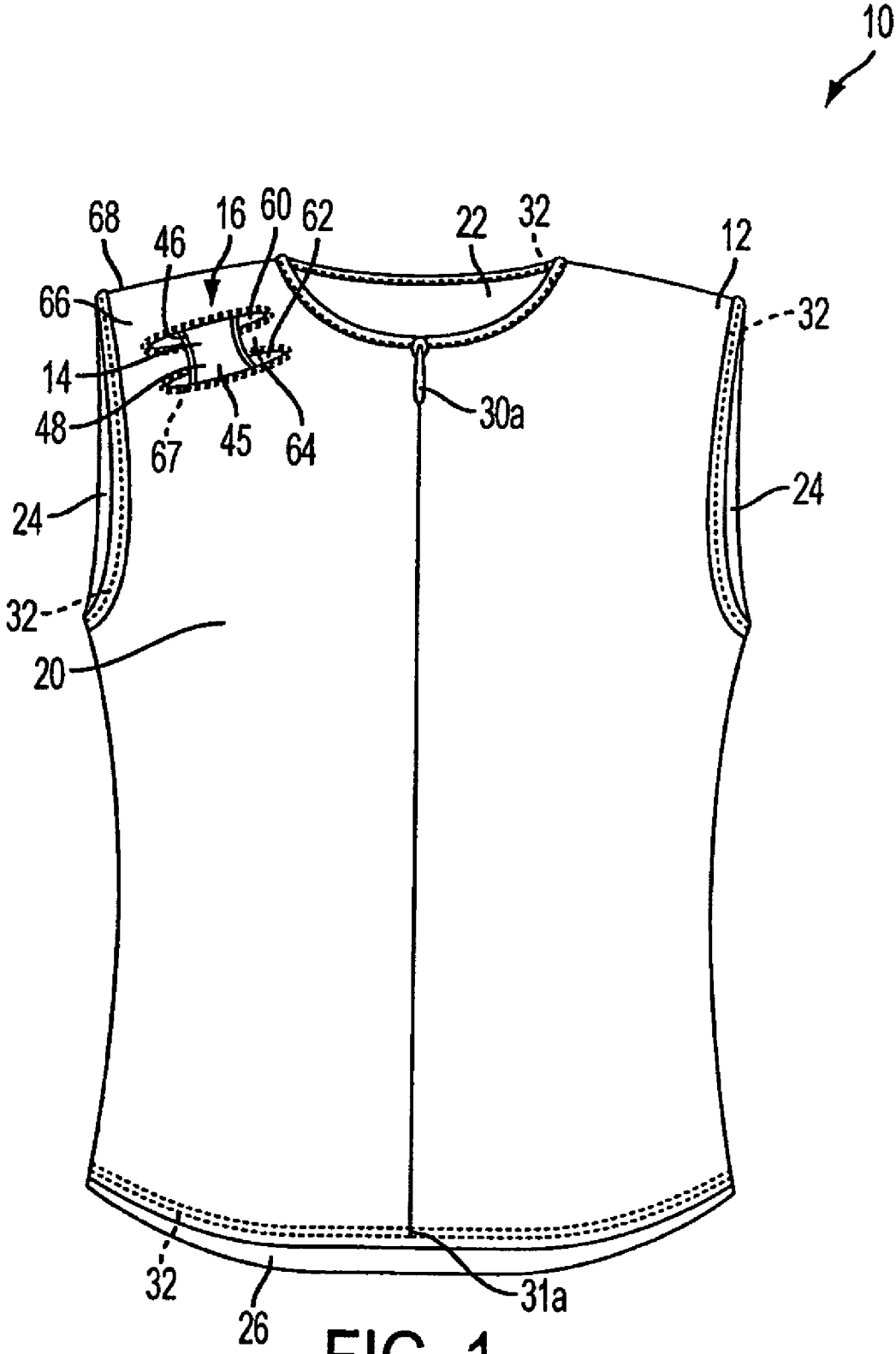
FIG. 1 is a front view of an illustrative ladies garment in accordance with the present invention.
Figure 2:
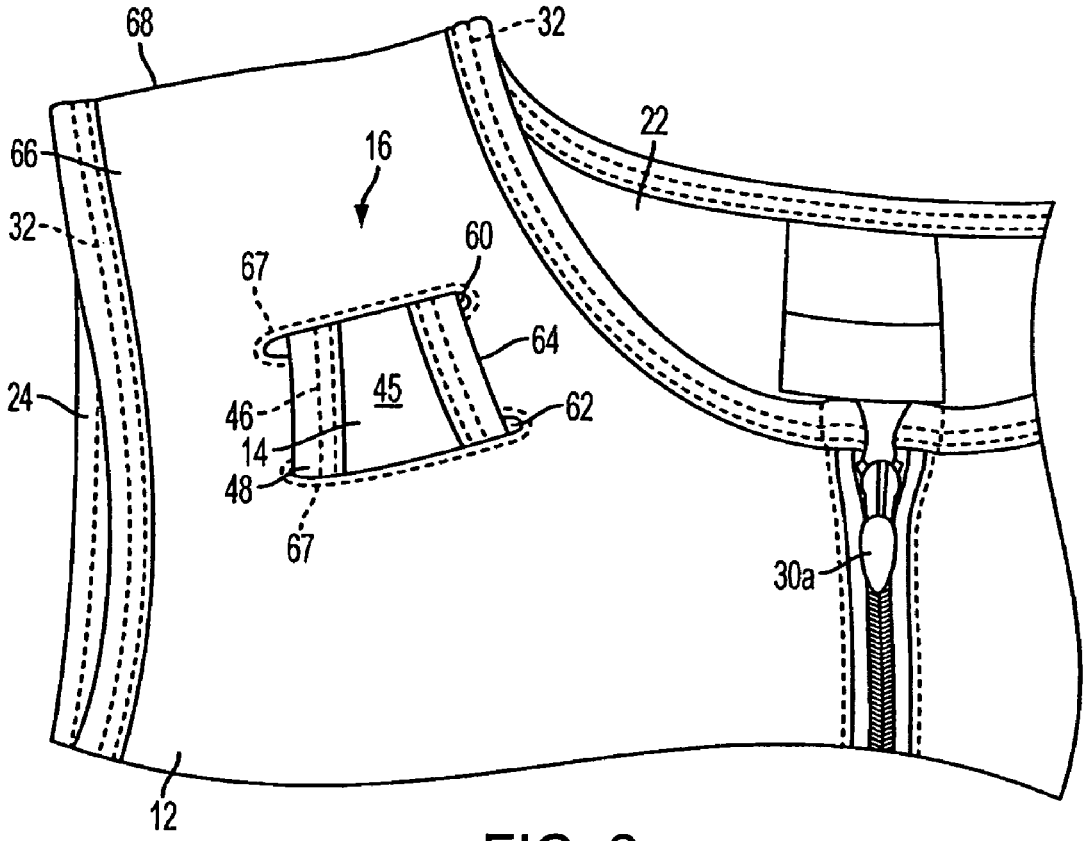
FIG. 2 is an enlarged detail view of the shoulder region of FIG. 1.

As can be seen in FIGS. 1 and 2, an illustrative embodiment of the outer garment 12 includes a torso covering portion 20 and applicable openings including a head/neck opening 22 at the top of the outer garment 12, arm openings 24 at the top sides of the garment 12 and a main body opening 26 for the torso at the bottom of the outer garment 12. The portions of the outer garment 12 framing the openings 22, 24, and 26 are reinforced by edge treatments 32 to support the garment around the openings and prevent fraying. The edge treatments 32 may be formed by applicable edge stitching and/or binding, and may be formed in any of a number of different manners as is known in the art. In lieu of edge treatments 32, the material may be cut in a special manner, such as by laser cutting, to minimize the possibility of fraying. In an illustrative arrangement, the torso covering portion 20 is sleeveless. However, in other embodiments, not shown, sleeves may be provided as part of outer garment 12.

The outer garment 12 may also be split from the collar or head opening 22 downward and may be provided with a zipper 30 to facilitate the processes of putting on and removing the garment 10. The zipper 30*a* and the outer garment 12 split may extend completely down to the bottom 31*a* of the outer garment 12 as shown in FIG. 1. That is, the split and the zipper 30*a* may extend from the neck opening 22 to the bottom main torso opening 26. In a variation of this arrangement as shown in FIG. 5 and described in more detail hereinafter, the zipper 30*b* and the split may extend down and its bottom 31*b* may terminate at an area that generally overlies the region of the wearer (when properly sized) in front of the base of the sternum. That is, the split and the zipper 30*b* can extend from the collar 24 only part way down the outer garment 12 such that it terminates in a center front portion of the outer garment 12.

FIGS. 3 and 4 show the garment 10 in an inside-out configuration showing aspects of the internal bra 14 in more detail. The internal bra 14 includes a front portion 40 that covers and supports the breasts when worn, left and right shoulder straps 42 that extend up from the front portion 40 and over the respective shoulders towards the back of the bra, and left and right side support regions 44 that extend from the front portion 40 around the respective side. The side support regions 44 extend around the sides of the wearer's torso and form a single strap or two rear straps that join in the back (not shown). If desired, two rear strap portions are used. A fastening element (not shown) may be used to couple the rear strap elements together. The shoulder straps 42 extend over the shoulder and terminate at and are fixed to the rear strap or straps. This provides good support for the wearer in various athletic activities. The front portion 40 may include a center panel 41 made of a more breathable material than the remainder of the front portion 40. When worn, the center panel 41 would be disposed between the breasts and would provide enhance breathablilty without adversely sacrificing support. In illustrative embodiments, as depicted, the shoulder straps 42 include edge treatment 46 on both side edges which may be formed by applicable edge stitching and/or binding as previously described. In lieu of edge treatments 46, the material edges may be cut in a special manner, such as by laser cutting, to minimize the possibility of fraying. In the shoulder region, the shoulder straps 42 include breathable material 45 in between the side edge treatments 46.

In the depicted embodiments, the reveal region 16 is illustrated in the front shoulder region 66. It is referred as such herein because, in an assembled state, it reveals a portion of the internal bra 14, e.g., an exposed visible portion 48 of the internal bra 14. The outer garment 12 includes slits in the front shoulder region 66 to help form the reveal region 16. In the embodiments shown in the figures, there are two slits which include the upper slit 60 and lower slit 62. The outer garment 12 includes material 64 between the slits 60 and 62 which is partially covered by the exposed visible portion 48 of the internal bra 14.

In an illustrative arrangement, the upper slit 60 is positioned between the shoulder seam 68 to a within 4.5 inches down from the shoulder seam 68. Additionally, in the illustrative arrangement, the upper and lower slits 60 and 62 are spaced from each other by a positive distance that is within the range between 0.25 inches and 3.5 inches. In addition, the upper and lower slits 60 and 62 may be generally parallel to each other.

In an illustrative arrangement, the upper and lower slits 60 and 62 each has a width between 0.5 and 4 inches. Additionally, the lower slit 62 is preferably 0.125 to 0.625 inches wider than the upper slit 60. The slits 60 and 62 are located between the head opening 22 and the arm opening 24. In an illustrative arrangement, both slits 60 and 62 are within 0.5 inches and 2.5 inches from both the head opening 22 and the arm opening 24. The regions of the outer garment 12 immediately surrounding the slits 60 and 62 may have edge treatments 67 that can be formed by applicable edge stitching and/or binding, and may be formed in any of a number of different manners as is known in the art. In lieu of edge treatments 67, the material at the periphery of the slits 60 and 62 may be cut in a special manner, such as by laser cutting, to minimize the possibility of fraying.

In the depicted arrangement, the upper slit 60 is positioned approximately 2.25 inches down from the shoulder seam 68, the upper and lower slits 60 and 62 are spaced from each other by approximately 0.75 inches; the upper slit 60 is approximately 1.75 inches wide; the lower slit 62 is approximately 2 inches wide; and both slits 60 and 62 are centered between the head opening 22 and the arm opening 24, leaving approximately 1 inch on either side. It is recognized that other embodiments of the invention may have different ranges and sized than what has been specifically described with respect to this illustrative arrangement.

The exposed portion 48 of internal bra 14 is visible in the front shoulder region 66. More specifically, the exposed portion 48 of the internal bra 14 is routed through the upper and lower slits 60 and 62 in succession such that exposed portion 48 extends from slit 60 to slit 62 and covers all, substantially all, or a portion of the material 64 between the slits 60 and 62. Thus, the portions of the shoulder strap 42 above the upper slit 60 and below the lower slit 62 are internal to the outer garment 12, and such may be seen from the inside out views of FIGS. 3, 4, and 6.

In one arrangement, the exposed portion 48 of the bra strap 42 that is weaved through slits 60 and 62 start at 1.5 inches wide (at the bottom) tapering to 1.25 inches (at the top) for ease of sliding through the slits/cutouts 60 and 62. The tapering of the strap 42 and the inclusion of slits 60 and 62 of different widths may be desirable because it may help to better center the shoulder strap 42. However, the bra strap 42 in this region may be of any desirable width, and the strap 42 need not taper.

The arrangement shown in FIGS. 5 and 6 is similar to that in FIGS. 1-4, with like features being labeled with similar reference numbers. In addition to the zipper 30 variations, the outer garment 12 of FIGS. 5 and 6 include a side panel material patch 92 that provides a visible contrast in appearance to the outer garment 12. In this arrangement, the material in the exposed portion 48 of the shoulder strap 42 has a similar appearance to the material in patch 92 and a contrasting material appearance to that of outer garment 12. This coordination of having the side panel material patch 92 and the exposed portion 48 of the shoulder strap 42 having a similar appearance provides a visual queue to notice the presence and technology of the internal bra 14. Additionally, the side panel material patch 92 is made from a higher stretch material than the outer garment 12 which can further assist the user in putting on and removing the garment 10.

Additionally, while the depicted embodiments include an asymmetrical arrangement for the reveal region 16, e.g., the reveal region 16 is only on one side, the present invention includes an embodiment that includes reveal regions 16 on both sides so that each of shoulder straps 42 extends through respective slits 60 and 62 on both sides of the outer garment 12.

Any desired material may be used for the internal bra 14 and/or the outer garment 12. In an illustrative arrangement, the material is breathable and stretchable. A woven blend of polyester, cotton, nylon, spandex, and/or lycra may be used to achieve this result. In one arrangement, material that is a woven blend of 92% tactel nylon and 8% spandex is used. In another arrangement, a woven blend of 88% polyester and 12% polyester is used. In yet another arrangement, a woven blend of 80-90% polyester and 20-10% spandex is used. However, any desired material can be used. Mesh material may also be used for various portions of the internal bra 14 and/or the outer garment 12. For example, the center panel 41 of the internal bra 14 and/or the material 45 in the shoulder straps 42 may be of a breathable mesh.

Garment 10 may be assembled in any desired manner. In one method, the outer garment 12 and the internal bra 14 are constructed separately. However, in the construction of the internal bra 14, the shoulder straps 42 have opposing free ends at a location. The internal bra 14 is properly positioned relative to the outer garment 12 and one of the free ends is routed from the inside through one of the slits 60 or 62 and is then routed back through the other of the two slits 62 or 60 so that the bra shoulder strap 42 produces an appearance as shown in the figures. The free ends of the shoulder strap 42 may then be attached to each other and the internal bra 14 would then be in a non-removable state relative to the outer garment 12. If desired, the internal bra 14 may be sewn or otherwise attached to other portions of the outer garment 12. In the embodiment where both shoulder regions include reveal regions, both shoulder straps 42 would preferably be split so that each could be routed through its respective slits.

The assembly as described above related to a permanent attachment technique. In an alternative arrangement, the free ends of the shoulder strap 42 may be provided with a removable fastening system, such as Velcro, that would hold under wear conditions but could be manually de-coupled. Such an arrangement permits the user it to mix and match internal bras 14 so that the visible portion 48 of the shoulder strap 42 could be color matched to a desired outer garment 12 color or colors.

To wear the garment 10, the wearer could pull the internal bra 14 and outer garment 12 over her head with the outer garment 12 in an unzipped state. She would place her arms in the arm openings 24 and her head and neck through the head opening 22. The high stretch material of the internal bra 14 and outer garment 12 will permit this method of dressing. The zipper 30 may then be zipped to the desired height and the garment 10 is ready for wear.

One benefit achieved by this arrangement is that it reveals a technology of a bra support system in a garment, and does so in a unique and/or stylish manner that may be preferred by many consumers. Some wearers may also prefer the feel and comfort of the unique fit arrangement by the internal bra 14 and outer garment 12 tensioning in the front shoulder region 66. One benefit of this is that a purchaser can determine the presence and type of support without having to approach and perform a detailed inspection of the garment. This is beneficial in a shopping environment as it is not uncommon for purchasers to consider style and/or support factors in limited time periods, and the user can immediately recognize the benefit of buying this garment by seeing a built in support system.

Another advantage of this arrangement is that it minimizes the stretching of the outer garment 12 in the region of the exposed strap because the bra shoulder strap 42 naturally tensions the outer garment 12 in that region. Further, because of the relationship where the exposed portion 48 of the tensioned bra strap 42 overlays the material between the slits 64 of the outer garment 12, this region can be used to hide or store a small object, such as a key, so that pockets may not be needed elsewhere on the outfit. This is especially useful because this garment 10 may be used for various athletic activities such as jogging.

While the various features of garment 10 work together to achieve the advantages previously described, it is recognized that individual features and sub-combinations of these features can be used to obtain some of the aforementioned advantages without the necessity to adopt all of these features. The present invention is disclosed above and in the accompanying drawings with reference to a variety of embodiments. The purpose served by disclosure of the embodiments, however, is to provide an example of the various aspects embodied in the invention, not to limit the scope of the invention. One skilled in the art will recognize that numerous variations and modifications may be made to the embodiments without departing from the scope of the present invention, as defined by the appended claims.

What is claimed is:

1. An article of apparel comprising:

an outer garment for covering a significant portion of the torso of a user, the outer garment having a first slit and a second slit, the first and second slits being spaced from each other; and a bra, the bra being coupled to the outer garment, the bra having a strap, the strap extending through the first and second slits in succession;

wherein the bra is primarily internal to the outer garment but is exposed in a region between the first and second slits and wherein the outer garment includes an external left front shoulder region and a corresponding external right front shoulder region, and the bra strap extends through slits on only one of the external front shoulder regions and is thereby exposed on only one of the external shoulder regions.

2. The article of apparel of claim 1, wherein the outer garment is sleeveless.

3. The article of apparel of claim 1, wherein the first slit is positioned above the second slit and the first slit is wider than the second slit.

4. The article of apparel of claim 1, further comprising edge treatment surrounding the first slit and the second slit.

5. The article of apparel of claim 4, wherein the edge treatment includes stitching around each of said first and second slits.

6. The article of apparel of claim 1, wherein the first and second slits are generally parallel to each other.

7. The article of apparel of claim 6, wherein the first and second slits each have a width between 0.5 and 4 inches, and are spaced from each other by a distance between 0.25 inches and 3.5 inches.

8. The article of apparel of claim 1, wherein the bra and outer garment are removably coupled to each other.

9. The article of apparel of claim 1, wherein the bra and outer garment are permanently attached to each other.

10. The article of apparel of claim 1, wherein the first slit is approximately centered between an arm opening and a neck opening.

* * * * *

UNITED STATES PATENT AND TRADEMARK OFFICE

CERTIFICATE OF CORRECTION

PATENT NO. : 7,628,675 B2
APPLICATION NO. : 11/098514
DATED : December 8, 2009
INVENTOR(S) : AnDrea Staub It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1264 days.

Signed and Sealed this

Second Day of November, 2010

David J. Kappos

David J. Kappos
*Director of the United States Patent and Trademark Office*